US010011462B2

(12) United States Patent
Ooms et al.

(10) Patent No.: US 10,011,462 B2
(45) Date of Patent: Jul. 3, 2018

(54) DEVICE AND RAIL SYSTEM FOR CONVEYING A LOAD FROM A FIRST TO A SECOND LEVEL, IN PARTICULAR A STAIR LIFT

(71) Applicant: Otto Ooms B.V., Bergambacht (NL)

(72) Inventors: Alex Ooms, Bergambacht (NL); Jan Otto Ooms, Bergambacht (NL); Jeroen Klaasjan Verbrugge, Delft (NL)

(73) Assignee: Otto Ooms B.V., Bergambacht (NL)

( * ) Notice: Subject to any disclaimer, the term of this patent is extended or adjusted under 35 U.S.C. 154(b) by 988 days.

(21) Appl. No.: 14/380,013

(22) PCT Filed: Feb. 27, 2013

(86) PCT No.: PCT/NL2013/050120
§ 371 (c)(1),
(2) Date: Aug. 20, 2014

(87) PCT Pub. No.: WO2013/129923
PCT Pub. Date: Sep. 6, 2013

(65) Prior Publication Data

US 2015/0034423 A1 Feb. 5, 2015

(30) Foreign Application Priority Data

Feb. 29, 2012 (NL) ..... 2008385

(51) Int. Cl.
*B66B 9/08* (2006.01)

(52) U.S. Cl.
CPC ..... *B66B 9/0846* (2013.01); *B66B 9/0815* (2013.01)

(58) Field of Classification Search
CPC ..... B66B 9/0846; B66B 9/0815
See application file for complete search history.

(56) References Cited

U.S. PATENT DOCUMENTS

| | | | | |
|---|---|---|---|---|
| 7,156,208 | B2 * | 1/2007 | Rickaby | B66B 9/0838 104/288 |
| 2004/0104078 | A1 * | 6/2004 | Szentistvany | B66B 9/0815 187/201 |

FOREIGN PATENT DOCUMENTS

| | | | | |
|---|---|---|---|---|
| EP | 2216284 | | 8/2010 | |
| WO | WO 0132543 | A1 * | 5/2001 | B66B 9/0815 |
| WO | WO 2005085116 | A2 * | 9/2005 | B66B 9/0815 |
| WO | WO 2007046690 | A1 * | 4/2007 | B66B 9/0838 |

* cited by examiner

*Primary Examiner* — Michael A Riegelman
(74) *Attorney, Agent, or Firm* — Marcus C. Dawes; Daniel L. Dawes

(57) ABSTRACT

A device (1) for conveying a load from a first to a second level, in particular a stair lift (4), comprising a rail (3) and a frame (9) which is movable along said rail (3), on which a load carrier (10) is mounted and which is provided with support and guide means (16, 17, 33, 36) that engage around at least part of the rail (3), which rail (3) extends above steps of a staircase near a wall or a handrail on one side of the staircase, the rail (3) comprising a tube and a strip (6) that extends radially away from the tube surface, which strip (6) is engaged by the support and guide means (16, 17, 33, 36), whereby the strip (6) extends obliquely from the tube in a direction that extends between the horizontal direction toward the wall or the handrail and the vertical direction toward the steps.

11 Claims, 2 Drawing Sheets

Figure 1:
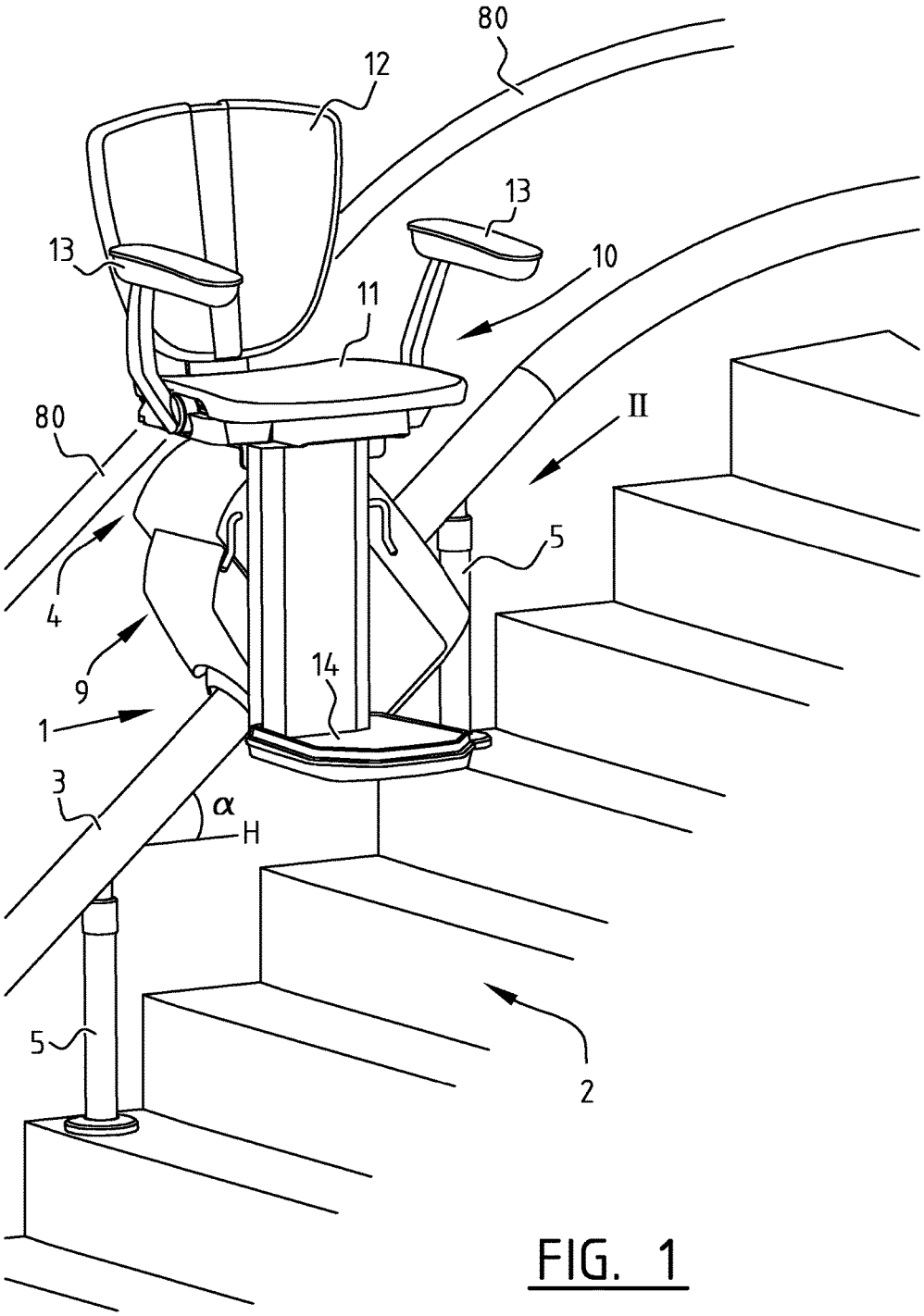

DEVICE AND RAIL SYSTEM FOR CONVEYING A LOAD FROM A FIRST TO A SECOND LEVEL, IN PARTICULAR A STAIR LIFT

The invention relates to a device for conveying a load from a first to a second level, in particular a stair lift, comprising a rail and a frame which is movable along said rail, on which a load carrier is mounted and which is provided with support and guide means that engage around at least part of the rail, which rail extends above steps of a staircase near a wall or a handrail on one side of the staircase, the rail comprising a tube and a strip that extends radially away from the tube surface, which strip is engaged by the support and guide means.

Such a device is described in European patent publication EP 2 216 284.

In the device that is known from the aforesaid patent publication, the strip extends horizontally toward the wall or the hand rail, whilst a gear rack extends at the bottom side. In a practical variant of the known device, the strip extends vertically toward the steps, whilst a gear rack is provided on the wall or handrail side.

The object of the invention is to provide a device and a rail system by means of which a more compact device can be realised, as a result of which more free space will remain on the staircase, so that a device of simpler design can be used and/or the device can easily evade obstacles present on or near the staircase, such as walls and ceilings.

In order to achieve that object, the strip extends obliquely from the tube in a direction that extends between the horizontal direction toward the wall or the handrail and the vertical direction toward the steps.

As a result of said oblique orientation, the space in the corner formed by the steps on the one hand and the wall or the handrail on the other hand can be optimally utilised, so that the tube of the rail can extend closer to the steps and/or the wall/handrail. In some situations, the invention may even have the advantage that the orientation of the load carrier (usually a chair) about the vertical axis need not be reversed, for example in order to enable a user to move along a low ceiling.

The strip preferably extends obliquely from the tube in a direction that includes an angle with the horizontal direction toward the wall or the handrail, which angle ranges between 15 and 75 degrees, more preferably between 30 and 60 degrees, even more preferably between 40 and 50 degrees.

The strip is preferably provided with a surface-mounted gear rack or with gear rack recesses, which is/are engaged by a driven gear of the support and guide means, as described in the aforesaid patent publication. In an alternative embodiment, it is also possible to use a friction-based traction drive instead of a rack-and-pinion drive.

The teeth of the surface-mounted gear rack or of the gear rack recesses preferably extend obliquely upward, substantially transversely to the strip.

Preferably, the side of the strip remote from the tube is connected to the steps, the wall or the handrail by means of rail fixing means. The rail fixing means preferably comprise substantially vertically extending posts, which are fixed to the steps.

The staircase usually comprises horizontally extending platforms, where the rail extends horizontally, as well as bends, where the rail goes around a bend. The frame in that case comprises means for keeping the load carrier in a fixed orientation while moving along the rail, as described in the aforesaid patent publication.

The invention also relates to a rail system intended and suitable for use in the device as described in the foregoing, comprising a rail which extends above steps of a staircase near a wall or a handrail on one side of the staircase, which rail comprises a tube and a strip that extends radially away from the tube surface, characterised in that the strip extends obliquely from the tube in a direction that extends between the horizontal direction toward the wall or the handrail and the vertical direction toward the steps.

Figure 2:
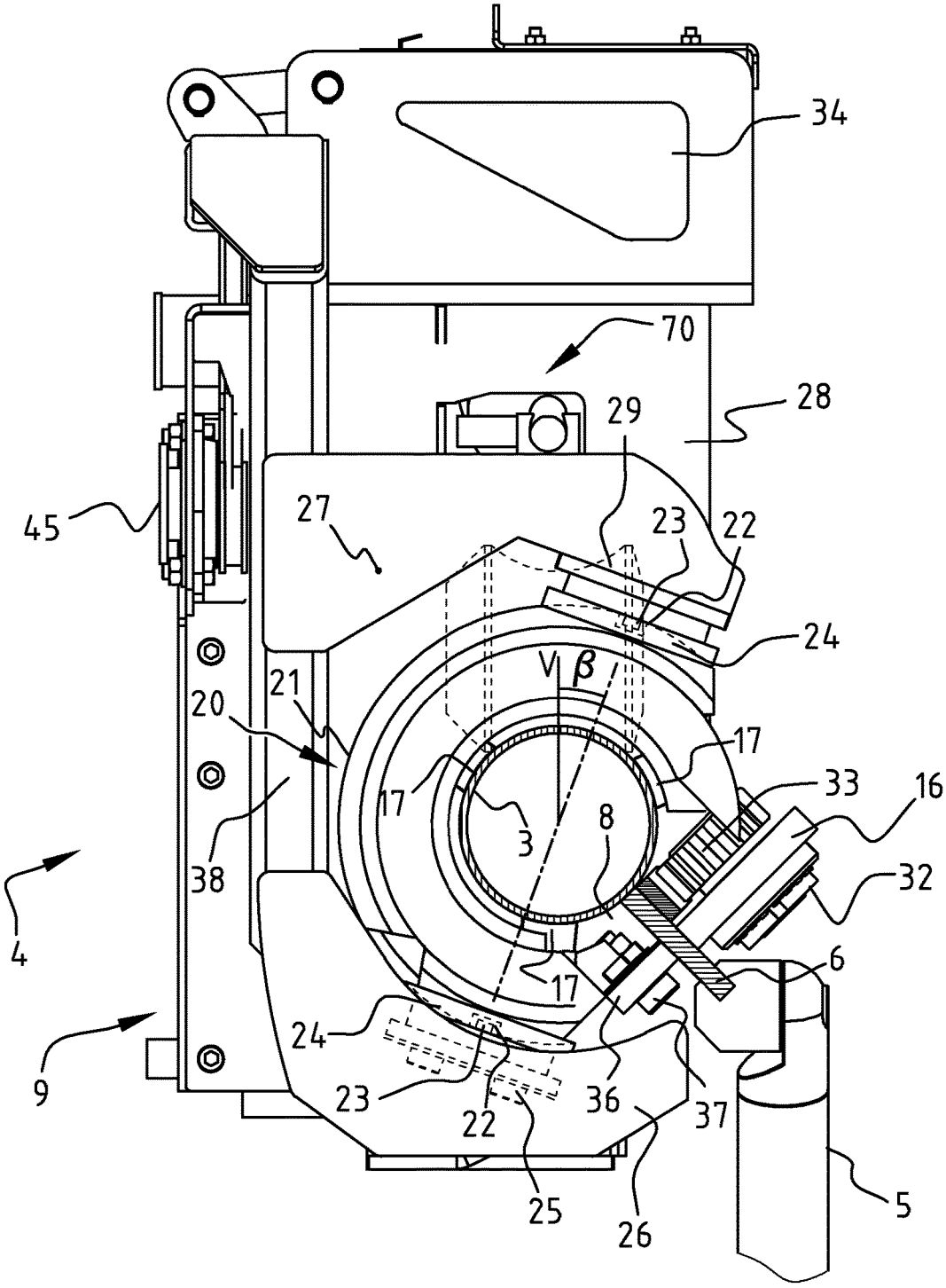

The invention will now be explained in more detail by means of an embodiment shown in the figures, in which:

FIG. 1 is a perspective front view of a stair lift installation according to a first embodiment of the invention; and FIG. 2 is a side view of a part of the stair lift installation according to arrow II in FIG. 1.

An installation 1 for conveying a load from a first level to a second level (see FIG. 1), a stair lift installation in the illustrated embodiment, comprises a rail 3 mounted along a staircase 2, which rail includes an angle a with the horizontal H, and a device 4, which is movable along the rail 3, for transporting the load between the various levels, in this case a stair lift, therefore. The rail 3, which has a round cross-section in the illustrated embodiment, is supported by a number of posts 5 disposed in spaced-apart relationship along the staircase 2, which posts are fixed to a projecting part in the form of a strip 6 (see FIG. 2), which extends along the rail 3. In an alternative embodiment it is also possible to secure the posts 5 directly to the rail 3, in which case the support wheel 36 will be connected to the support wheel 16 by means of a substantially U-shaped bracket which extends round the strip 6. The function of the strip 6 will be explained in more detail yet hereinafter. The rail 3 further comprises a driving part, in this case in the form of a gear rack 8. A handrail 80 is provided along the stairs 2.

From the rail, the strip 6 slopes down at an angle of 45 degrees to a horizontal line in the direction of the wall beside the staircase 2. The strip provided with the gear rack 8 is thus hardly visible, if at all, to a person taking the stairs, which may be an additional aesthetic advantage.

The stair lift 4 comprises a frame 9 which is movable along the rail 3, on which frame a load carrier 10 is mounted, in this case in the form of a chair with a seat part 11, a backrest 12, armrests 13 and a footrest 14. The chair 10 is pivotally connected to the frame 9 about a horizontal shaft 45 (FIG. 2), whilst the frame 9 houses a maintaining mechanism 70, which comprises, among other parts, an adjusting motor connected to the shaft 45, so that the position of the chair 10 can be kept constant at all times, irrespective of the inclination of the rail 3.

The frame 9 of the stair lift 4 is further provided with support and guide means, which engage round a part of the circumference of the rail 3. The frame 9 is to that end substantially L-shaped, with an upright back 38 and two feet 26 engaging under the rail 3. Support and guide means are adapted to absorb moments directed transversely to the direction of movement of the stair lift 4. To this end the support and guide means comprise a number of guide rollers 17 disposed at intervals in the direction of movement, which rollers engage the rail 3. In the illustrated embodiment, several pairs of guide rollers 17 are even provided, which, in addition, are spread over the circumference of the rail 3. Because a large number of guide rollers 17 are used, each of said guide rollers can be comparatively small, so that a compact construction is obtained. In addition, the loads on the stair lift 4 are thus spread uniformly over the rail 3 and resistance is minimized.

In the illustrated embodiment, the roller carrier 20 is configured as a ring segment having a spherical outer surface 21, which is open to one side. The open side functions to allow the ring segment to engage round the strip 6 of the rail 3. The illustrated embodiment comprises two roller carriers 20, each of which is provided with three pairs of rollers 17, which pairs are spaced 120° apart in circumferential direction. Each roller carrier 20 is mounted at two diametrically opposite points in cup-shaped dishes 24 connected to the frame 9, such that it is in principle movable in all directions. The dishes 24 are fixed to the foot 26 projecting under the rail 3 and to a part 27 of the frame 9 engaging over the rail 3 by means of a number of screws 25. An imaginary line connecting the roller carriers 20 includes a small angle β with the vertical V.

In order to limit the movability of the roller carrier 20 to two mutually perpendicular directions transversely to the direction of movement of the stair lift, i.e. a tilting movement transversely to the rail 3, two grooves 22 extending substantially in the direction of movement are formed in the outer surface 21, in each of which grooves a pin 23 engages. Said pin 23 projects from the centre of the cup-shaped dish 24. The sliding movement of the pins 23 in the grooves 22 thus allows pivoting of the roller carrier 20 about a substantially horizontal axis, whilst pivoting of the roller carrier 20 about the pins 23 is also possible. On the other hand, the pins 23 prevent tilting movement about the longitudinal axis of the rail 3. In this way it is readily possible to follow bends in the staircase 2, and thus also in the rail 3, which generally involve turns both in the horizontal and in the vertical plane.

The stair lift 4 is also provided with drive means 16, which co-act with the driving part of the rail 3 in the form of the gear rack 8. Said drive means 16 are accommodated in a subframe 28, which has a reverse L-shape in this embodiment and which is formed between the feet 26 of the frame 9. A roller 29 is mounted for rotation about a shaft 30 in the subframe 28, so that the subframe 28 is supported on the rail 3. The drive means 16 comprise a motor having an output shaft 32, on which a gear 33 is mounted, which gear engages the gear rack 8 of the rail 3. In the illustrated embodiment, two batteries 34 are provided at the top of the subframe 28 for supplying power to the motor.

A support wheel 36 is rotatably mounted on a shaft 37. As a result, a moment directed round the rail 3, which is the result of the weight of the load carrier 10 and the load carried by said load carrier 10, can be absorbed by the drive means.

In the illustrated embodiment, the output shaft 32 extends beyond the gear rack 8 and the gear 33 up to the edge of the strip 6. In order to ensure that the toothed wheel 33 will mesh optimally with the gear rack 8, another support wheel 16 is rotatably mounted on the projecting part of the shaft 32, opposite the support wheel 36, which support wheel engages the strip 6 of the rail 3. The subframe 28 of reverse L-shape with the support wheel 36 mounted therein and the projecting shaft 32 with the support wheel 16 thus form a unit which encloses the rail 3 practically entirely.

An embodiment of a very similar device, the only essential difference being the fact that the strip 6 provided with the gear rack 8 extends horizontally and that the support and guide means are therefore rotated relative to the embodiment shown herein, is described in more detail in Dutch patent NL 2002503 (European patent publication EP 2 216 284).

The invention claimed is:

1. A device for conveying a load from a first to a second level comprising:

a rail;

a frame which is movable along said rail; and a load carrier mounted to the frame which is provided with support and guide means that engage around at least part of the rail, wherein the rail extends above steps of a staircase near a wall or a handrail on one side of the staircase, and comprises a tube and a strip that extends radially away from the tube surface, which strip is engaged by the support and guide means, wherein the strip extends obliquely from the tube in a direction that extends between a horizontal direction toward the wall or the handrail and a vertical direction toward the steps, and wherein the strip extends obliquely from the tube in a direction that includes an angle of between 15 and 75 degrees with the horizontal direction toward the wall or the handrail.

2. A device according to claim 1, wherein the strip extends obliquely from the tube in a direction that includes an angle of between 30 and 60 degrees with the horizontal direction toward the wall or the handrail.

3. A device according to claim 1, wherein the strip extends obliquely from the tube in a direction that includes an angle of between 40 and 50 degrees with the horizontal direction toward the wall or the handrail.

4. A device according to claim 1, wherein the strip is provided with a surface-mounted gear rack or with gear rack recesses, which is/are engaged by a driven gear of the support and guide means.

5. A device according to claim 1, wherein the teeth of the surface-mounted gear rack or of the gear rack recesses extend obliquely upward, substantially transversely to the strip.

6. A device according to claim 1, wherein the side of the strip remote from the tube is connected to the steps, the wall or the handrail by means of rail fixing means.

7. A device according to claim 6, wherein the rail fixing means comprise substantially vertically extending posts, which are fixed to the steps.

8. A device according to claim 1, wherein the staircase comprises horizontally extending platforms where the rail extends horizontally.

9. A device according to claim 1, wherein the staircase comprises bends where the rail goes around a bend.

10. A device according to claim 1, wherein the frame comprises means for keeping the load carrier in a fixed orientation while moving along the rail.

11. A rail system using the device according to claim 1, comprising a rail which extends above steps of a staircase near a wall or a handrail on one side of the staircase, the rail further comprising a tube and a strip that extends radially away from the tube surface, and in that the strip extends obliquely from the tube in a direction that extends between the horizontal direction toward the wall or the handrail and the vertical direction toward the steps.

* * * * *